US005140841A

United States Patent [19]

Offermann et al.

[11] Patent Number: 5,140,841

[45] Date of Patent: Aug. 25, 1992

[54] CONTROL SYSTEM FOR WARP YARNS

[75] Inventors: Peter Offermann; Olaf Diestel; Gerd Franzke, all of Dresden; Rainer Berthold, Karl-Marx-Stadt; Hannes Schramm, Dresden, all of German Democratic Rep.

[73] Assignee: Malimo Maschinenbau GmbH, Chemnitz, Fed. Rep. of Germany

[21] Appl. No.: 715,317

[22] Filed: Jun. 13, 1991

Related U.S. Application Data

[63] Continuation of Ser. No. 128,247, Dec. 3, 1987, abandoned.

[30] Foreign Application Priority Data

Dec. 31, 1986 [DD] German Democratic Rep. ..... 2989058

[51] Int. Cl.[5] ..... D04B 23/00

[52] U.S. Cl. ..... 66/207; 66/84 R

[58] Field of Search ..... 66/84 R, 204, 207, 214

[56] References Cited

U.S. PATENT DOCUMENTS

| | | | |
|---|---|---|---|
| 3,303,670 | 2/1967 | Bassist | 66/207 |
| 3,563,060 | 2/1971 | Titone | 66/207 |
| 4,614,095 | 9/1986 | Porat | 66/207 |

FOREIGN PATENT DOCUMENTS

| | | | |
|---|---|---|---|
| 220632 | 4/1985 | German Democratic Rep. | 66/207 |
| 1085643 | 10/1967 | United Kingdom | 66/214 |

*Primary Examiner*—Werner H. Schroeder
*Assistant Examiner*—John J. Calvert
*Attorney, Agent, or Firm*—Jordan and Hamburg

[57] ABSTRACT

In a textile machine including needles for forming a plurality of warp yarns into stitches and a guide bar for guiding the warp yarns to the needles, the guide bar is constructed to lay warp yarns in patterns without moving the entire guide bar by providing the guide bar with at least one guide block movable relative to a fixed point on the guide bar. Each of the guide blocks includes a respective guide for one or more warp yarns. At least one guide block is connected in a chain configuration to at least one distance altering element, and the distance altering element is controlled to variably alter the distance between the guide block and the fixed point.

11 Claims, 14 Drawing Sheets

CONTROL SYSTEM FOR WARP YARNS

This application is a continuation of application Ser. No. 07/128,247, filed Dec. 3, 1987.

BACKGROUND OF THE INVENTION

The invention relates to a control system for warp yarns and stitch-forming textile machines, particularly warp knitting machines and stitch-bonding machines.

Stitch-forming textile machines are generally known, in which one or more guide bars are equipped with yarn guides intended to guide the warp yarns, in order to produce the pattern. Disadvantages of these machines are the pattern size, which is limited due to the slight displacement of the guide bars, the fact that all the yarns, laid with one guide bar, can only be laid in a similar manner, and the high level of energy consumption, as well as the disadvantageous dynamics resulting from the high masses of the guide bars, when several guide bars are used.

Furthermore, stitch-forming textile machines are known, which work with a so-called Jacquard device, which allows lateral displacement of the yarn guides by one or two needle spacings. Here, the slight displacement of the yarn guides and the patterning possibilities determined by this are disadvantageous.

It is an object of the invention to reduce the energy consumption involved in patterning and to produce completely new patterning effects and structures on stitch-forming textile machines.

It is an object of the invention to provide a control device for warp yarns, which permits greater pattern and structure variability without the greater energy consumption resulting from additional guide bars.

SUMMARY OF THE INVENTION

Pursuant to the invention, this objective is accomplished in that for a control system for warp yarns on stitch-forming textile machines with at least one stationary warp yarn guide, which is constructed as a guide bar, or one or several warp yarn guides, which carry out known operating movements, and with at least one yarn guide block, which is equipped with at least one element for guiding the yarn and is assigned to the guide bar, at least one yarn guide block is disposed on an adjustment guide bar so that it can be moved transversely to the operating direction, a distance altering element, which effects a change in distance relative to a fixed point on the adjustment guide bar, is assigned to at least one yarn guide block, and the distance altering element is connected directly or indirectly with at least one control device. A fixed yarn guide block is arranged in a fixed position on the adjustment guide bar and several distance altering elements are connected to form a chain of elements and connected with a control device which acts on one or both sides, or distance altering elements are arranged between the yarn guide blocks, forming a chain of elements and blocks, and the element-block chain is connected with a control device which acts on one or both sides.

The distance altering element is constructed as an elastic expansion/shrinkage element or shrinkage/expansion element. The control device is integrated into the distance altering element. The distance altering element is formed as a spring and the expansion/shrinkage elements or shrinkage/expansion elements have different moduli of elasticity. A positioning element or controllable catch mechanism is assigned to at least one yarn guide block. The distance altering elements formed as springs have the same or different spring constants and the distance altering elements formed as expansion/shrinkage elements or shrinkage/expansion elements have different elasticity moduli or different geometrical formations. The control device contains a driving mechanism or a driving mechanism and a program control unit. A centering device is assigned to the yarn guide blocks. The control device is assigned to a pattern control.

BRIEF DESCRIPTION OF THE DRAWINGS

In the following, the invention is explained in more detail by reference to specific embodiments, as illustrated in the drawings, in which.

DETAILED DESCRIPTION OF PREFERRED EMBODIMENTS

Figure 1:
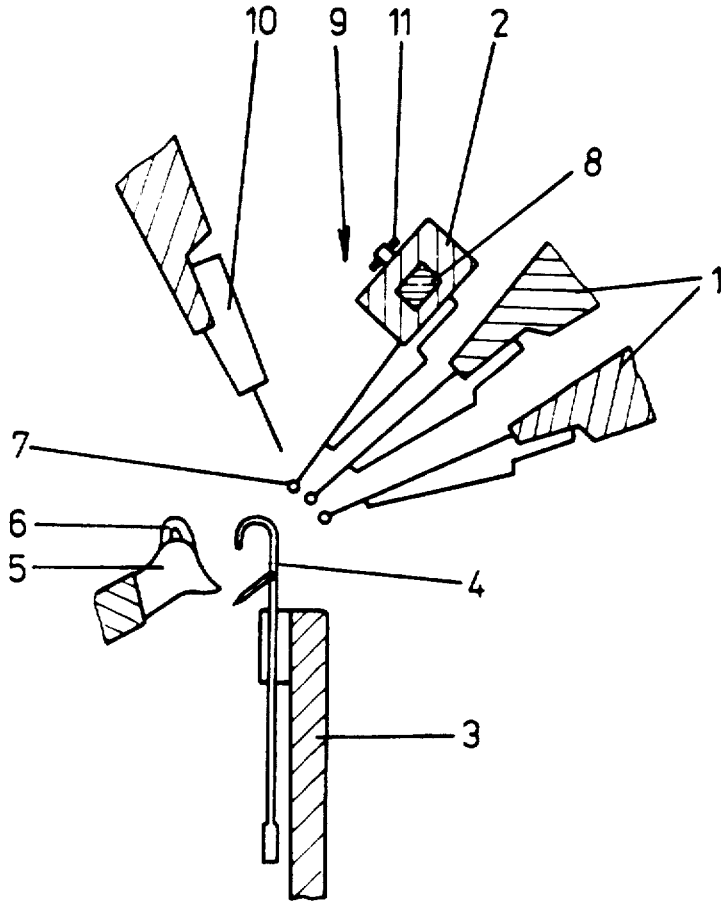
FIG. 1 is a side view, partly in section, of the warp knitting area of a warp knitting machine incorporating an embodiment of an adjustment guide bar according to the invention.
Figure 2:
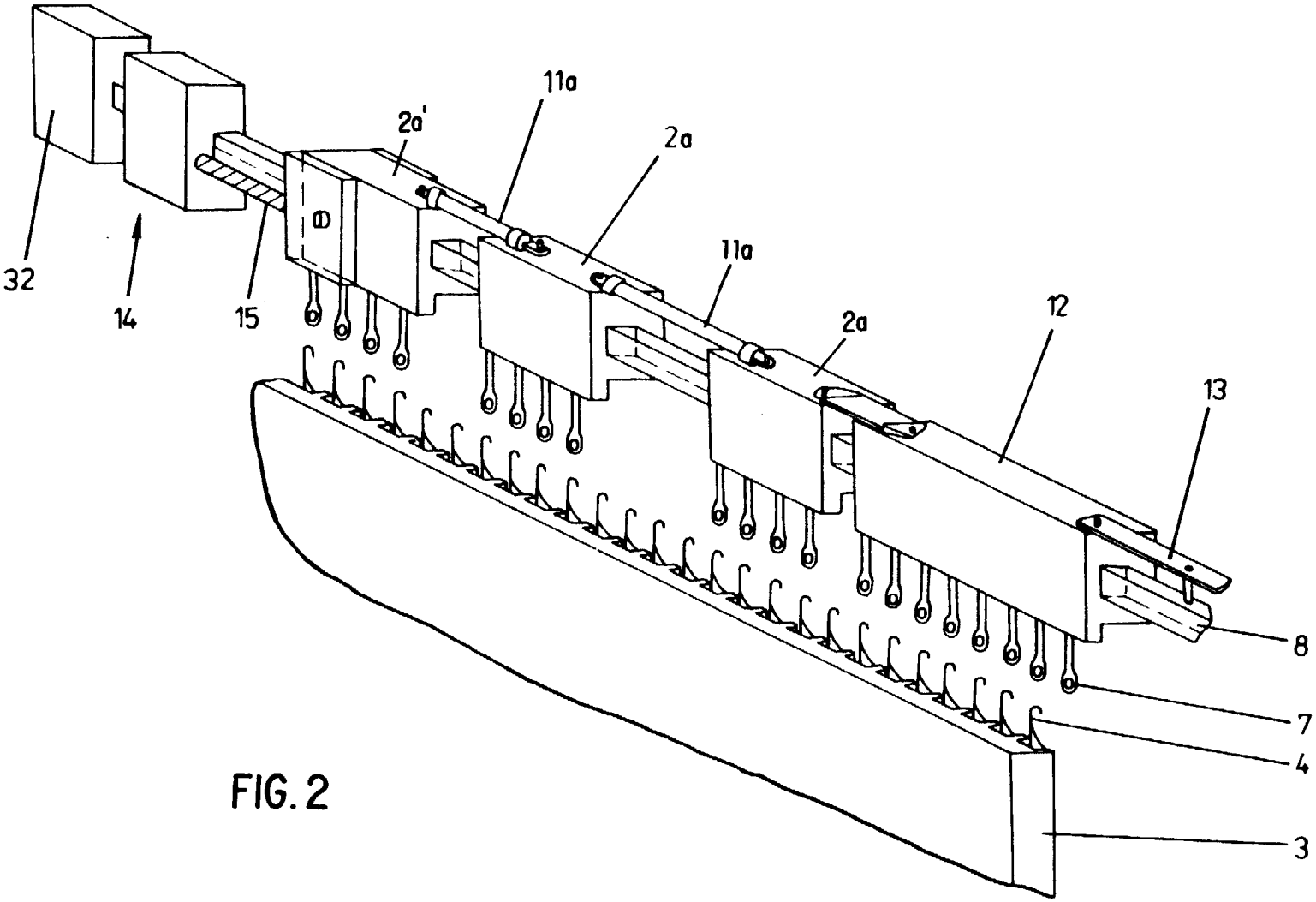
FIG. 2 is a perspective view of the needles and comb plate therefor of another embodiment of an adjustment guide bar according to the invention in the warp knitting area of another warp knitting machine.

FIGS. 1 and 2 each show a warp knitting area of a respective stitch-forming textile machine. The FIG. 1 warp knitting area is comprised, in known manner, of one or more warp yarn guides formed as laying rails 1, and in the embodiment shown, of two guide bars 1 and one adjustment guide bar 9 on the invention on a guide 8 of which at least one yarn guide block 2 is arranged, several latch needles 4 guided in a comb plate 3, a trace comb 5 with a latch holding wire 6, as well as a centering device 10 of the invention.

The one or more yarn guide blocks 2 of FIG. 1 are each equipped with one or more elements 7 in the form of guide needles to guide the yarn. Small hooks, tubes, eyes, etc. can also be used as elements 7 to guide the yarn. An end of a distance altering element 11 is fixed to a yarn guide block 2 and the other end is fixed to another yarn guide block.

Figure 3:
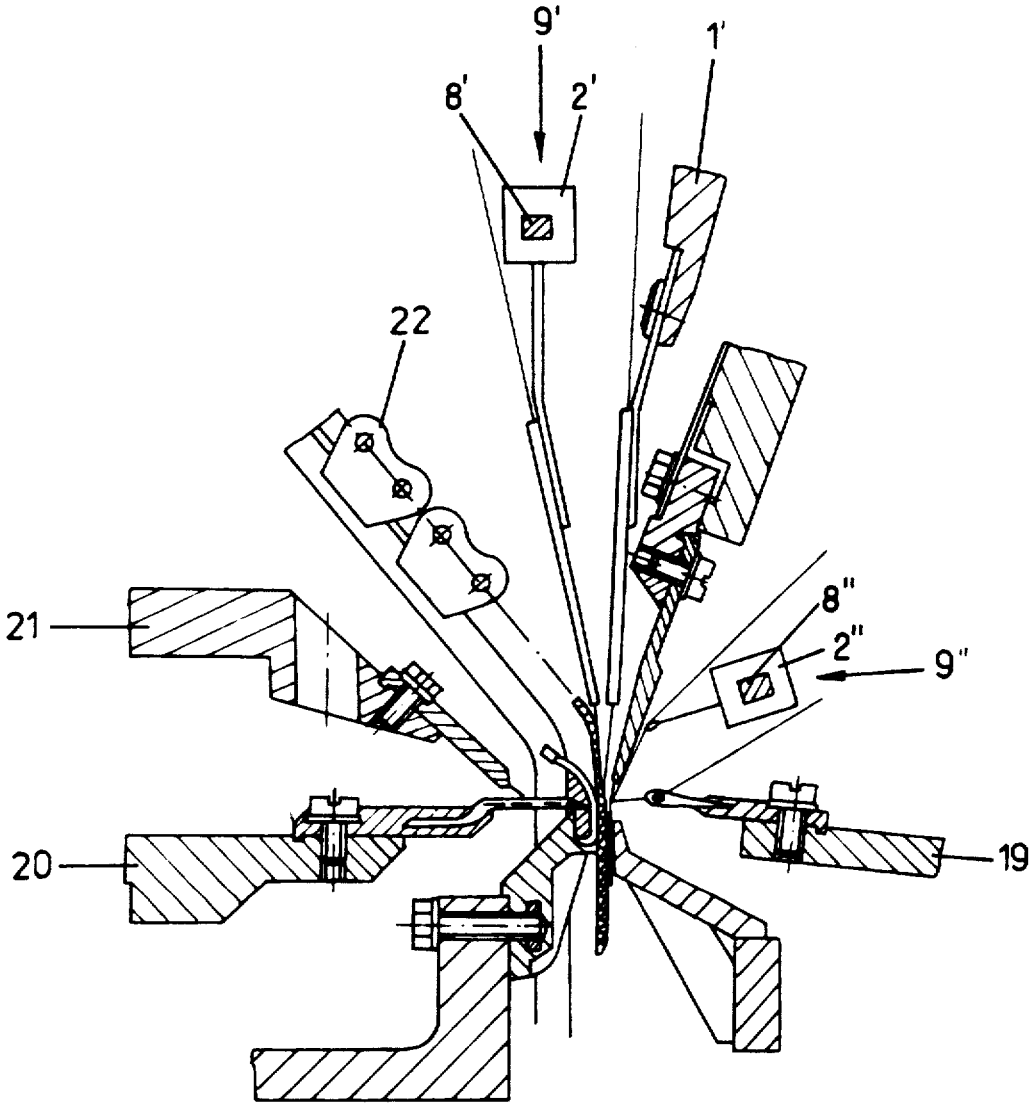
FIG. 3 is a side view, partly in section, of the stitch-bonding area of a stitch-bonding machine incorporating another embodiment of an adjustment guide bar according to the invention.
Figure 4:
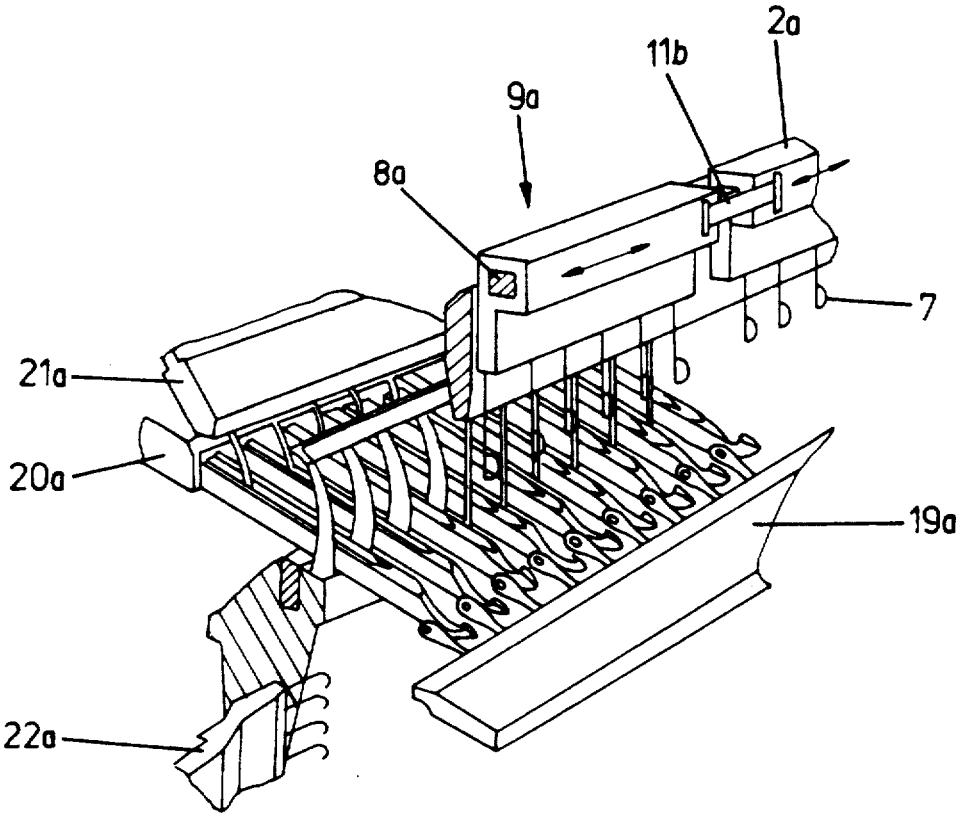
FIG. 4 is a perspective view of the stitch-bonding area of another stitch-bonding machine incorporating another embodiment of an adjustment guide bar according to the invention.

The invention can be used equally for warp knitting areas with two needle systems. FIGS. 3 and 4 each show a stitch-bonding area of respective stitch-forming textile machines. The known stitch-bonding area of FIG. 3 mainly comprises, aside from other known work elements, one or more warp yarn guides in the form of guide bars, in particular a guide bar 1' for the first pattern warp yarn system, an adjustment guide bar 9' of the invention for a second pattern warp yarn system and an adjustment guide bar 9'' for the stitch-bonding warp yarn system, with several yarn guide blocks 2', 2'' arranged on each of the adjustment guide bars, a knitting yarn guide bar 19, a slide needle dividing sinker 20 with a closing wire dividing sinker 21 and a filling yarn feed 22. Distance altering elements, as in the embodiment of FIG. 1, but not illustrated, are provided. Elements 2*a*, 8*a*, 9*a*, 19*a*, 20*a*, 21*a*, 22*a* in the embodiment of FIG. 4 do not require description because their counterparts are found in the embodiment of FIG. 3, the same numbers being used in FIG. 4 as in FIG. 3 for like elements but with the addition of a letter to denote differences in configuration from FIG. 3, distance altering elements 11*b*, in addition, being illustrated in FIG. 4.

The yarn guide blocks are each equipped with one or more elements in the form of guide needles 7 to guide the yarn. The term "warp yarns" is understood to mean a group of yarns, which are aligned parallel or next to one another in front of the work area, run into it and there are worked into a textile fabric, which already exists or is being created. The term "yarn" subsumes yarns, twisted yarns, filaments, filament cables, slubbings, fiber strips, strips of film, etc. Pursuant to the invention, each adjustment guide bar is equipped with a guide on which the yarn guide blocks are arranged so they can be moved transversely to the working direction, with this not precluding that at least one yarn guide block is arranged in a fixed position on the adjustment guide bar and thus constitutes a fixed yarn guide block 12 (FIG. 2).

Figure 14:
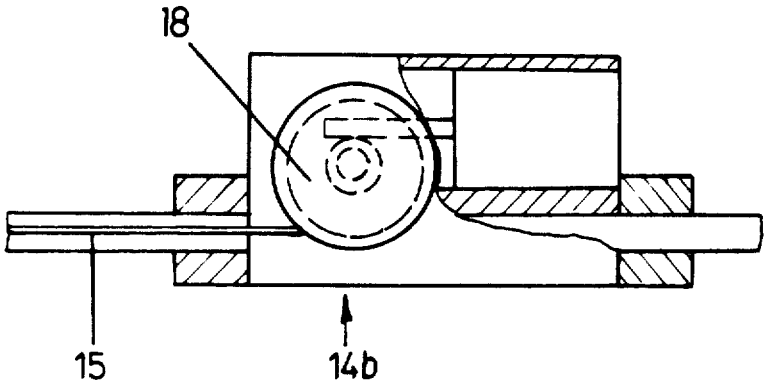
FIG. 14 is a front elevation view, partly in section, of yet another embodiment of the control device which may be used in place of the embodiment of FIG. 12.
Figure 13:
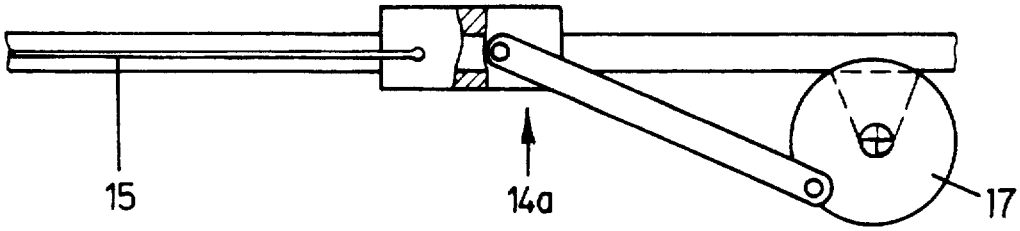
FIG. 13 is a front elevation view, partly in section, of another embodiment of the control device which may be used in place of the embodiment of FIG. 12.

In FIG. 2, the fixed yarn guide block 12 is connected to the guide 8 via a fixing element 13. Yarn guide blocks 2*a* and 2*a'* are interconnected by distance altering elements 11*a*. A control device 14 is indirectly assigned to at least one distance altering element 11*a* via a yarn guide block 2*a'*, in the embodiment shown in FIG. 2. Alternative control devices 14*a* and 14*b* are illustrated in FIGS. 13 and 14, respectively.

Figure 12:
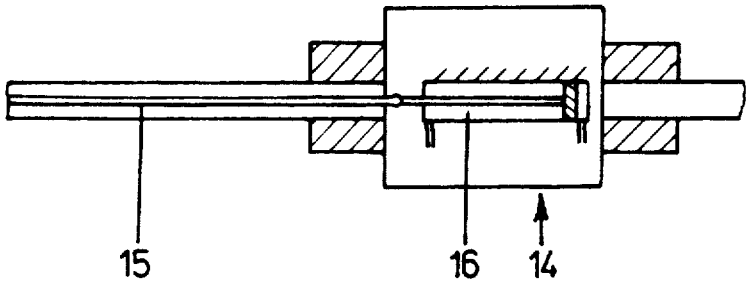
FIG. 12 is a front elevation view, partly in section, of a control device which is represented only generally in FIG. 2.

In a simple case (FIG. 12), the control device 14 contains a translation drive 16, for example a hydraulic work cylinder, which is connected with the yarn guide block 2 via a tension element 15 or directly. Other embodiments 14*a*, 14*b* of the control device such as a crank drive 17 (FIG. 13) or a roll-up drive 18 (FIG. 14), or drives not shown, such as control wedges, eccentrics, expansion drives, cam disk drives, chain drives or controls are possible. The control device 14 is arranged so that it acts unilaterally on the distance altering element 11 and formed in such a way, in known manner, that it can exert different forces and/or produce different altering paths and/or different altering velocities. A pattern control 32 is assigned to the control device. The pattern control 32 is a generally known punched tape control or a computer control, which guarantees starting and stopping of the control device 14 over one or more work cycles.

Figure 5A:
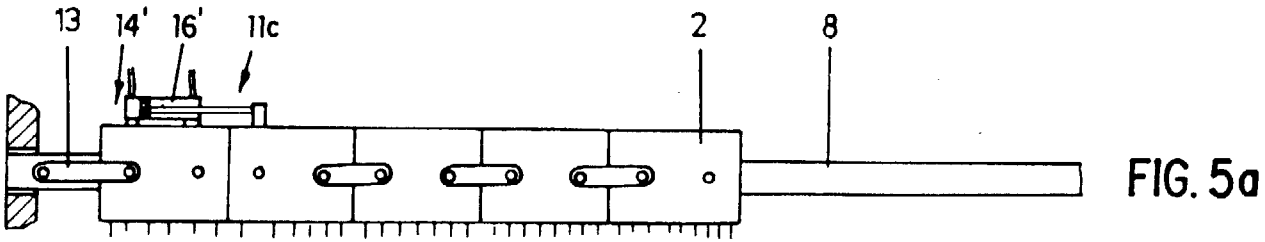
FIGS. 5(*a*) and 5 (*b*) are plan views of another embodiment of an adjustment guide bar according to the invention for use in any of the machines of FIGS. 1–4 in place of the adjustment guide bars illustrated therein, with the yarn guide blocks in a first position (FIG. 5(*a*)) and in a moved position (FIG. 5(*b*))
Figure 5B:
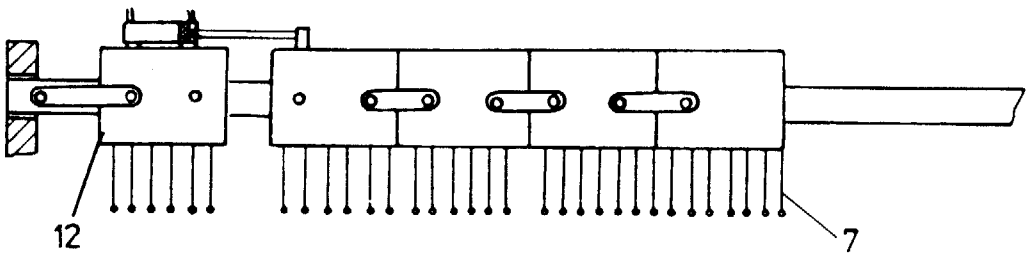

FIGS. 5(*a*) and 5(*b*) show an embodiment of the invention in two positions, the embodiment including a fixed yarn guide block 12 which is connected to the guide 8 of the guide bar via a fixing element 13 and several yarn guide blocks 2 which are connected to one another and arranged so they can be moved on a guide 8. An individual distance altering element 11*c* connected to a yarn guide block 2 is arranged on the fixed yarn guide block 12. Controllable wedges, eccentrics, etc. arranged between the yarn guide blocks 2, 12 can also be used as individual distance altering elements. The control device 14 is integrated into the distance altering element 11*c* in the form of a translation drive 14', for example a hydraulic work cylinder 16'.

Figure 6:
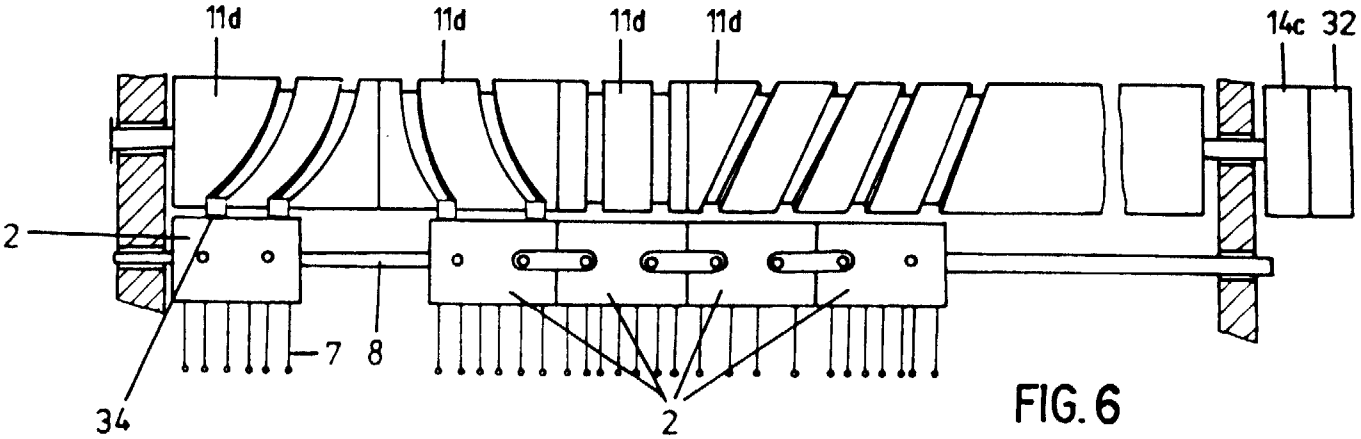
FIG. 6 is a plan view of another embodiment of an adjustment guide bar according to the invention for use in any of the machines of FIGS. 1–4 in place of the adjustment guide bars illustrated therein.

FIG. 6 shows an embodiment in which the distance altering elements 11*d* are connected together to form a chain of elements and the element chain is connected to a control device 14*c* in the form of a motor.

The distance altering elements 11*d* are formed as part of a control roller, into grooves in which guide pins 34 arranged on the yarn guide blocks 2 are received. Because of the varying inclination of the grooves of the control roller, or because of a variable assignment of the guide pins 34 to the grooves, a differing movement of the yarn guide blocks 2 relative to one another is possible.

Figures 7A, 7B:
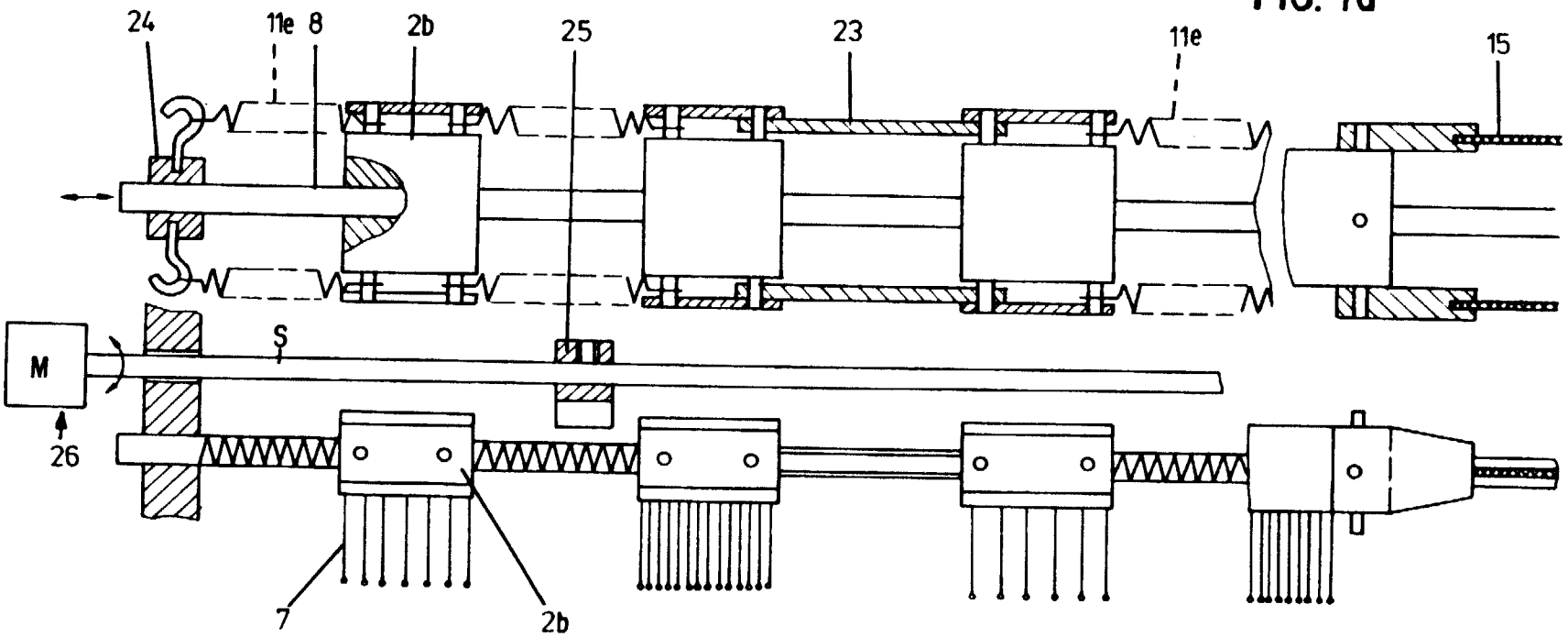
FIGS. 7(*a*) and 7(*b*) are, respectively, a front elevation view, partly in section, and a plan view, partly in section, of another embodiment of an adjustment guide bar according to the invention for use in any of the machines of FIGS. 1–4 in place of the adjustment guide bars illustrated therein.

FIGS. 7(*a*) and 7(*b*) show an embodiment in which the distance altering elements 11*e*, which are springs, are assembled together with the yarn guide blocks 2*b* to form a chain of elements and blocks, that is, the yarn guide blocks 2*b* are connected with one another via springs and a spacer 23, which maintains a fixed distance. Instead of tension springs, the use of compression springs is also possible. A control device (not illustrated), which acts unilaterally, is connected to one yarn guide block 2b via the tension element 15. A securing means 24 is fixedly arranged on the guide 8. The securing means 24 is connected to a yarn guide block 2b via distance altering elements 2e. The distance altering elements, i.e., springs, 11e, can be provided with the same or different spring constants.

Figure 8:
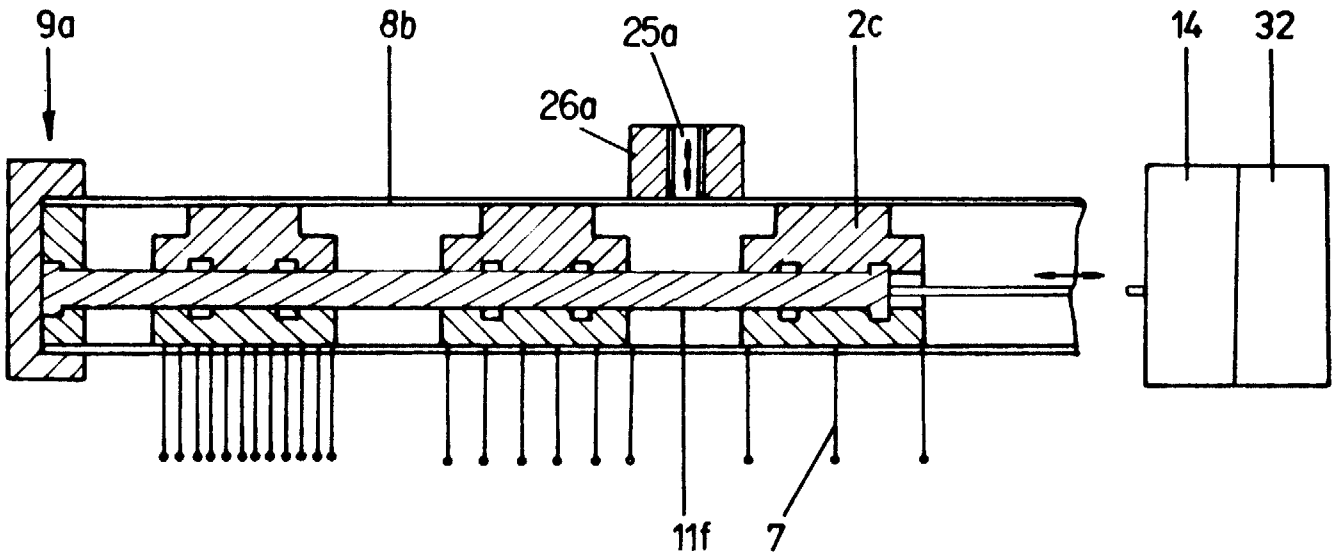
FIG. 8 is a plan view, partly in section, of another embodiment of an adjustment guide bar according to the invention for use in any of the machines of FIGS. 1–4 in place of the adjustment guide bars illustrated therein.

FIG. 7(*b*) also shows a positioning element 25. The positioning element 25 is connected to a control drive 26, in the form of a shaft S with a motor drive M. The positioning element 25 can be controlled within the path of a yarn guide block 2b and thus forms a path limitation for the yarn guide block 2b. FIG. 8 shows another embodiment of the invention. The yarn guide blocks 2c, which move on guide 8b of adjustment guide bar 9a, are arranged on an elastic distance altering element 11f, forming a chain of elements. The elastic distance altering elements 11f are, for example, rubber bands, which are stretched in the working phase by application of tension stress, and shrink back into their initial position in the non-working phase (expansion/shrinkage elements) or rubber blocks, which are compressed in the working phase by application of pressure, and expand back into their initial position in the non-working phase (shrinkage/expansion element).

The expansion/shrinkage elements or shrinkage/expansion elements can be provided with different moduli of elasticity. Furthermore, it is possible to vary the properties of the expansion/shrinkage elements or the shrinkage/expansion elements by different geometrical dimensions. The distance altering element 11f is arranged so that it is fixed on the adjustment guide bar 9a on the one side and connected to the control device 14 on the other side. The positioning element 25a, including the control drive 26a, is in the form of a controllable magnetic actuator.

Figure 9:
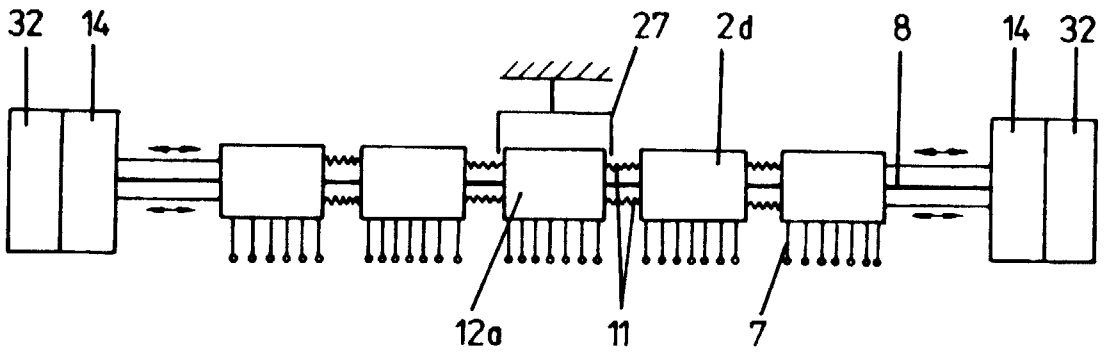
FIG. 9 is a plan view of another embodiment of an adjustment guide bar according to the invention for use in any of the machines of FIGS. 1–4 in place of the adjustment guide bars illustrated therein.
Figure 10:
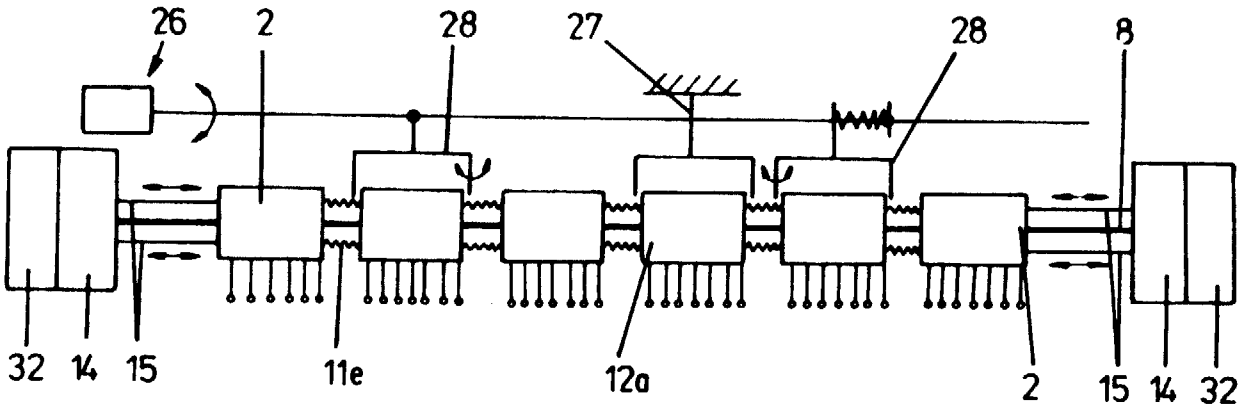
FIG. 10 is a plan view of another embodiment of an adjustment guide bar according to the invention for use in any of the machines of FIGS. 1–4 in place of the adjustment guide bars illustrated therein.

In contrast to FIG. 2, FIG. 9 shows an embodiment in which a centrally arranged yarn guide block is converted into a fixed yarn guide block 12a, the other yarn guide blocks 2d with distance altering elements 11e in the form of springs form a chain of elements and blocks, and a control device 14 is arranged on either side on the chain of elements and blocks. The conversion of a yarn guide block into a fixed yarn guide block 12a is carried out by way of a catch mechanism 27 arranged on the guide bar 8 or the frame. If the catch mechanism is formed as a controllable catch mechanism 28 (FIG. 10), a chain of elements and blocks all movable by a control device 14 arranged on either side is created part of the time. The controllable catch mechanism 28 is connected to the control drive 25, or through a spring to the control drive 25 in one variation of this embodiment.

Figure 11:
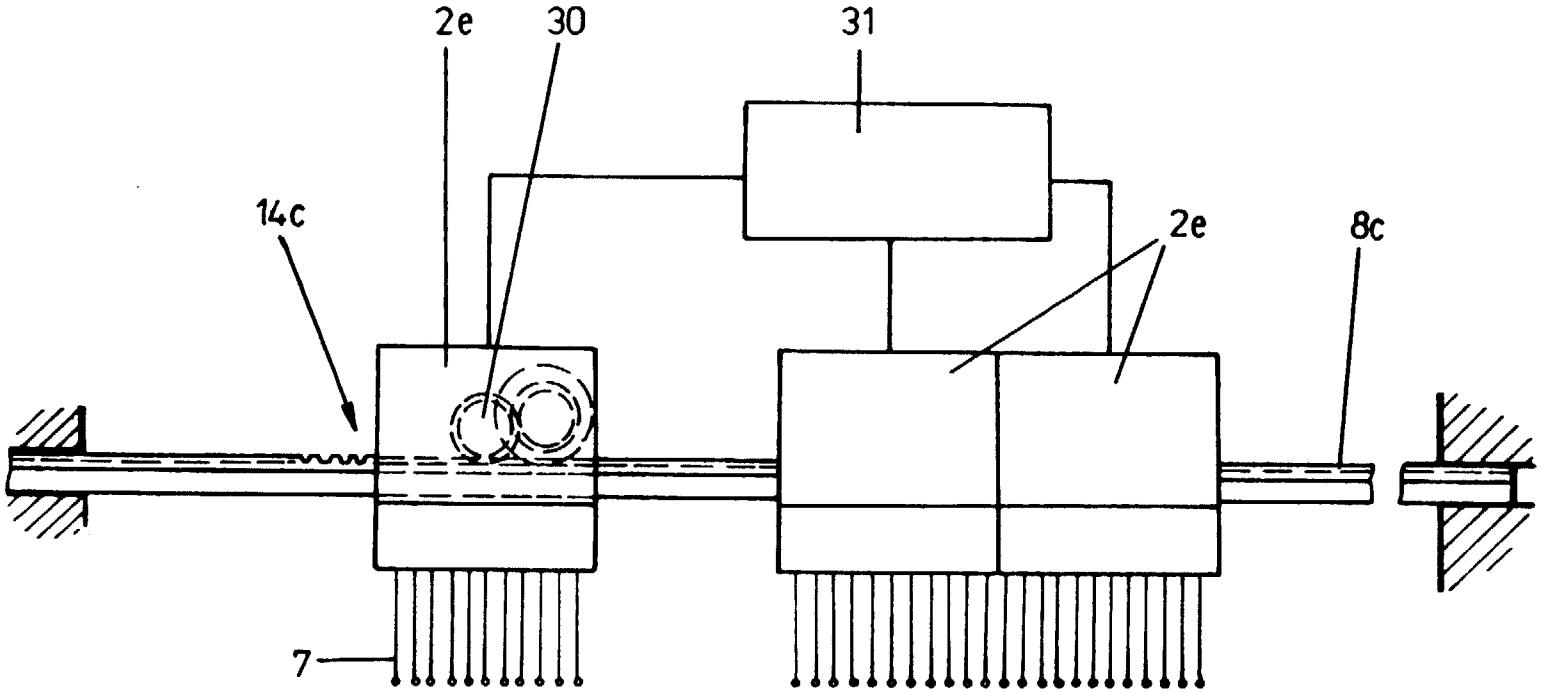
FIG. 11 is a plan view of another embodiment of an adjustment guide bar according to the invention for use in any of the machines of FIGS. 1–4 in place of the adjustment guide bars illustrated therein.

FIG. 11 shows a further embodiment of the invention. Here, at least one yarn guide block 2 is provided with a control device 14c formed as an individual drive. The guide 8c is constructed as a toothed rack and the control device 14c comprises this toothed rack 8c and a pinion 30 which meshes with the toothed rack 8c, the pinion acting together with a motor. The motors of the yarn guide blocks 2e are connected to a program control unit 31 incorporating a program control to coordinate the movements of the blocks. Coordination of the movement is necessary, in order to avoid a collision of the movable yarn guide blocks 2e with one another.

Figure 15:
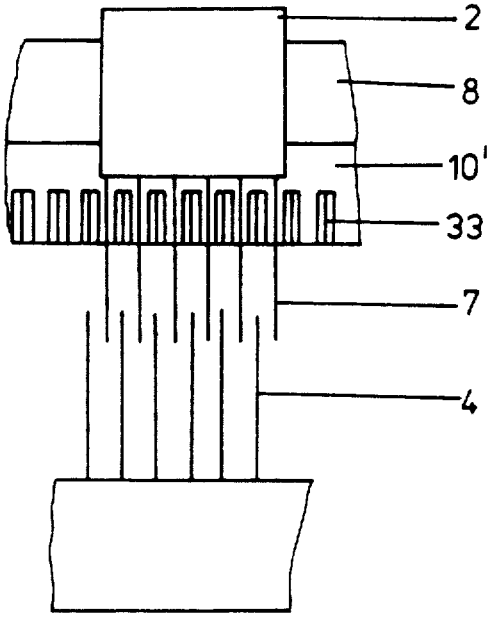
FIG. 15 is a front elevation view of the combination of a centering device according to the invention, an adjustment guide bar according to the invention and latch needles in a comb plate.
Figure 16:
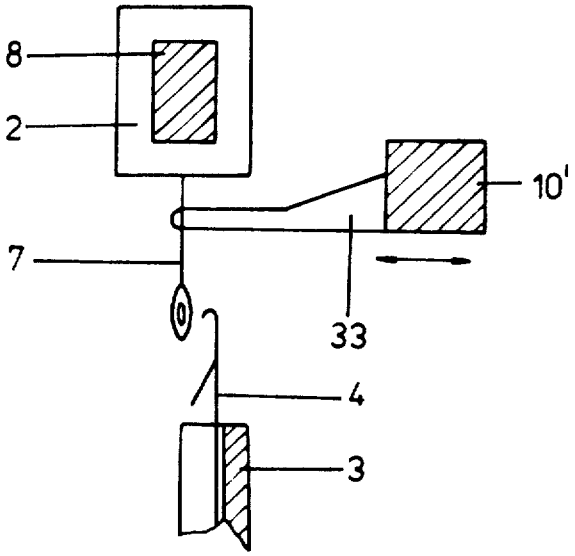
FIG. 16 is a side elevation view, partly in section, of the combination of FIG. 15.
Figure 17:
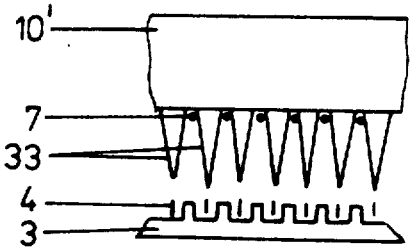
FIG. 17 is a plan view of the combination of FIG. 15.

FIGS. 15 to 17 show a centering device of the invention. The centering device 10' is arranged transversely to the processing direction and can be moved between the elements 7 for guiding the yarn. The centering device 10' contains wedge-shaped centering elements 33 disposed next to one another. In the following, the method of operation of the control device pursuant to the invention will be described.

The method of operation of the warp knitting area and of the stitch-bonding area is generally known and therefore need only be described briefly. The latch needle 4 shown in FIG. 1 performs the known movements for the stitch formation process, with which the movements of the guide bar 1 and/or the adjustment guide bar 9 for overlaying and/or underlaying the warp yarns and the movement of the trace comb 5 are synchronized.

The process is analogous in the stitch-bonding area (FIG. 3) during the motion of the compound or latch needle/closing system. The compound needles and the closing wires of the corresponding dividing sinkers 20, 21 penetrate the filling yarns which are brought to the area of operation by means of the filling yarn guide 22 and which are fixed in place to the well-known stitch-bonding fabrics by the knitting yarns, which are brought in by the knitting yarn guide bar 19 to form stitches. By means of the adjustment guide bars 9', 9'', which form the filling or the stitches, there is the possibility of producing via a mechanical or electronic pattern chain a plurality of patterns without great effort, without increasing the number of guide bars or without changing the guide bar control. The pattern width, in contrast to a single needle as in the Jacquard device, can go over several elements for guiding the yarn (guide needles) all the way to the entire working width.

Patterning takes place due to the separation of the yarn guide blocks or the movable arrangement of the same and the positional change of the yarn guide blocks, which guide the warp yarns, relative to a fixed point on the adjustment guide bar or relative to one another. In the embodiment shown in FIG. 2, a positional change—stretching the distance altering elements 11a—and therefore a change in the distance between the yarn guide blocks 2a is achieved by means of the control device 14. With this, the warp yarn arrangement is changed before stitch formation, and a pattern is produced. By a variation in the distance altering elements—springs (FIG. 7), expansion/shrinkage element such as a rubber band (FIG. 8), individual distance altering elements (FIG. 11) or control roller (FIG. 6), other distance altering elements such as expansion drives also being possible, the variation in the material properties or the geometrical formation of the distance altering elements (elasticity moduli, spring constants), the disposal of spacers 23 between the yarn guide blocks (FIGS. 7(*a*), 7(*b*)), the assignment of control devices 14 which act unilaterally (FIGS. 5(*a*), 5(*b*)) or bilaterally (FIGS. 9, 10), the arrangement of one or more fixed yarn guide blocks 12, 12a at desired points (edge, center), the arrangement of positioning elements 25, 25a which limit the path of the yarn guide blocks, as well as the special structure of the control devices (different forces, different paths, different velocity) as well as the assignment of a pattern control to the control device 31, an unlimited variety of patterns is possible. If only slight demands with regard to the accurate reproducibility of the pattern and/or the accuracy of laying of the yarns are made for the laying of the pattern yarns, that is,—the controlled adjustment guide bars are only brought to the work area and the warp yarns are tied on by a different yarn system or attached to a textile fabric in some other way.—the controlled adjustment guide bar does not have to be moved through the work area, is the use of the adjustment guide bar alone possible. If high demands are established for the laying of the pattern yarns, that is the controlled adjustment guide bars must perform a swinging motion through the needles, the use of the adjustment guide bars is possible only in conjunction with a centering device 10, 10'. The elements for guiding the yarn (guide needles) are centered to the exact distance between needles with the centering device, and a swinging motion through the needles is made possible.

FIGS. 18*a*–18*f* show pattern selections produced with the control system of the invention. The patterns shown are produced with one or two chains of elements and blocks, springs 11*e* being used as the distance altering elements; here, each yarn guide block $2_n$ (n=1, 2, 3, . . .) is equipped with only one element 7 for guiding the yarn. Each yarn block $2_1$, $2_2$, $2_3$, . . . produces a corresponding chain of stitches $C_1$, $C_2$, $C_3$, . . .

Figure 18B:
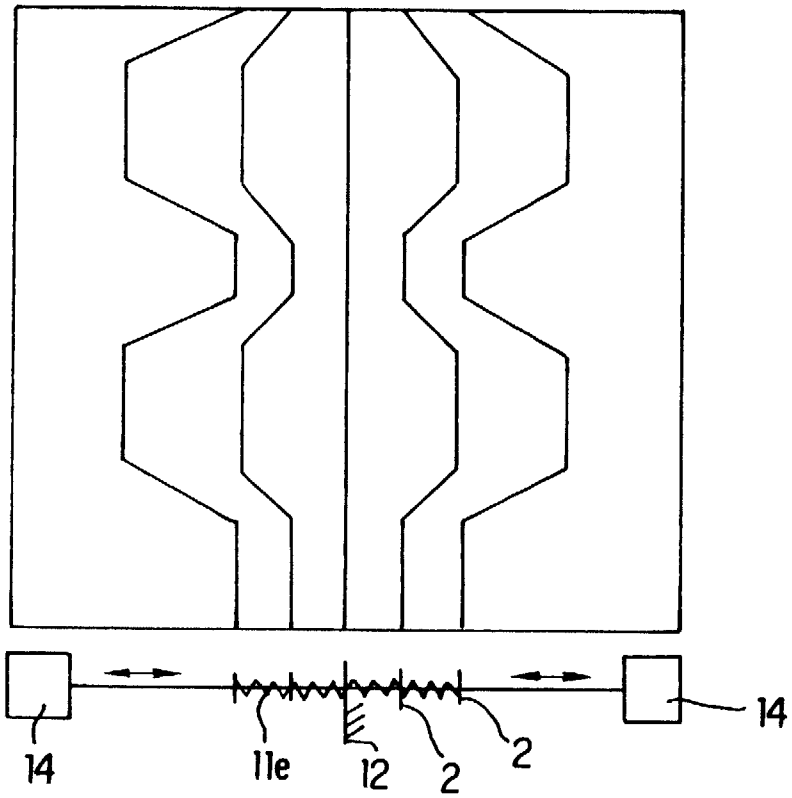
FIGS. 18(*a*) to 18(*f*) are each a schematic representation of a respective pattern of stitch chains combined with a schematic representation of an adjustment guide bar according to the invention which effected the pattern.
Figure 18A:
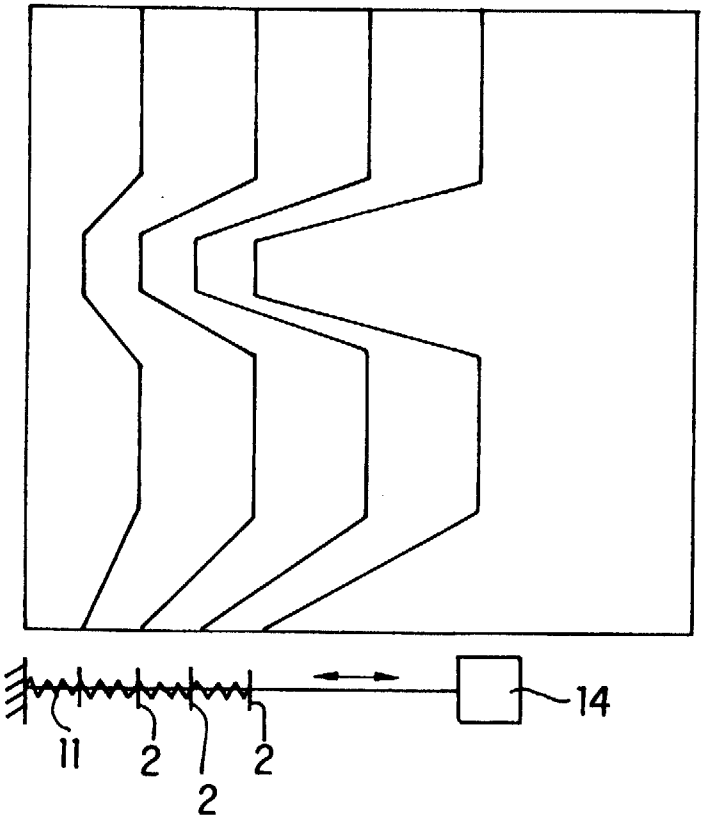

The pattern shown in FIG. 18*a* is produced by means of a chain of elements and blocks arranged in a unilaterally fixed position on the adjustment guide bar $9_1$ and connected with a unilaterally acting control device 14, the springs having the same spring constants. The pattern shown in FIG. 18*b* is produced by means of a chain of elements and blocks arranged on the adjustment guide bar $9_2$ with a fixed block 12*a* in the center, the block 12*a* being fixed by a catch mechanism 27 (FIG. 9). The chain of elements and blocks is connected with bilaterally acting control devices 14, the springs having the same spring constants, the bilaterally acting tensile forces applied by the control device being the same. The chain of stitches produced by the fixed block 12*a* is designated $C_{S1}$, the subscript "S" denoting "straight."

Figure 18D:
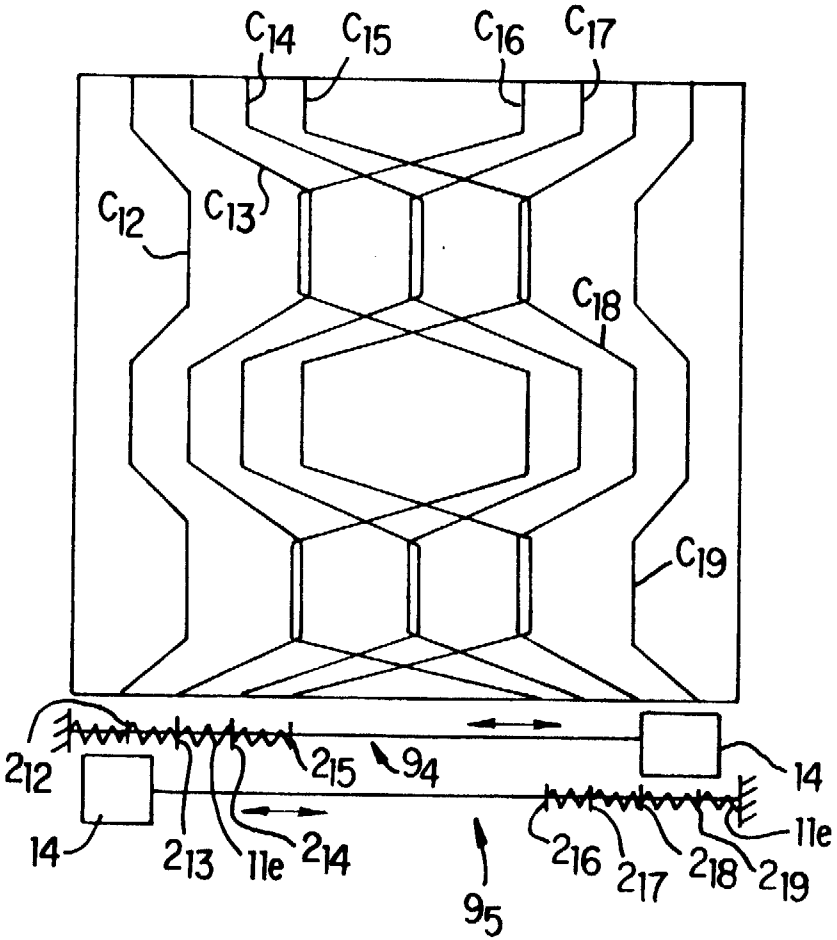
Figure 18C:
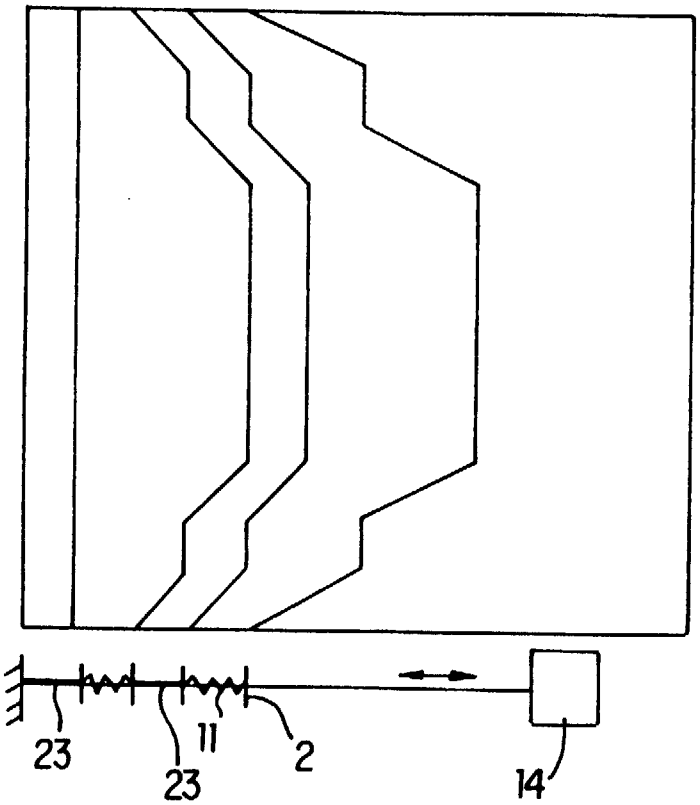

The pattern shown in FIG. 18*c* is produced by means of a chain of elements and blocks unilaterally fixed on the adjustment guide bar $9_3$ and connected with a unilaterally acting control device 14 which acts on one side, several spacers 23 being integrated into the chain of elements and blocks and the spring constant being the same. One of the blocks is a fixed block 12 and, therefore, produces a straight chain of stitches $C_{S2}$.

The pattern shown in FIG. 18*d* is produced by two chains of elements and blocks, laterally fixed in duplicate on respective adjustment guide bar $9_4$, $9_5$. Each chain of elements and blocks is connected with a respective control device 14.

Figure 18F:
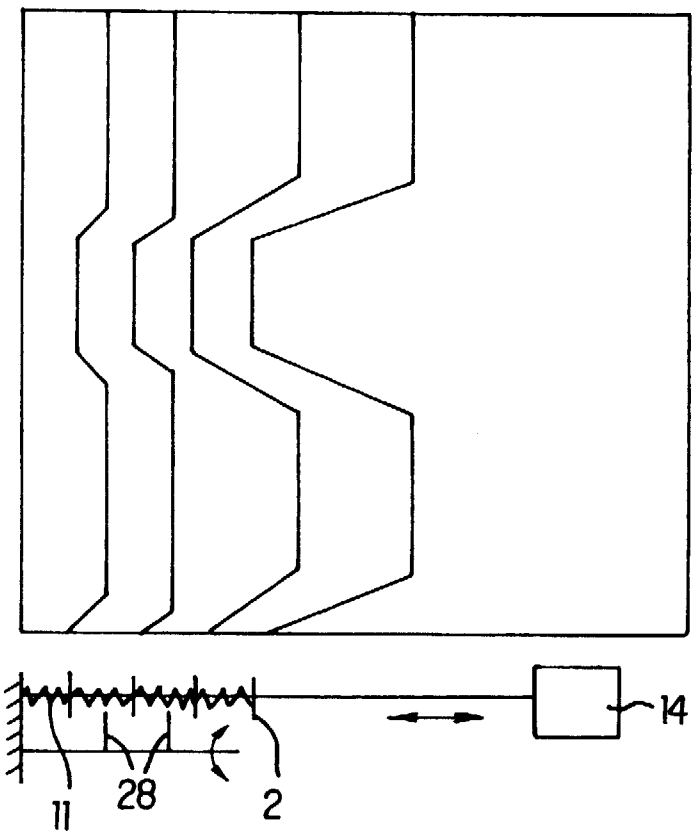
Figure 18E:
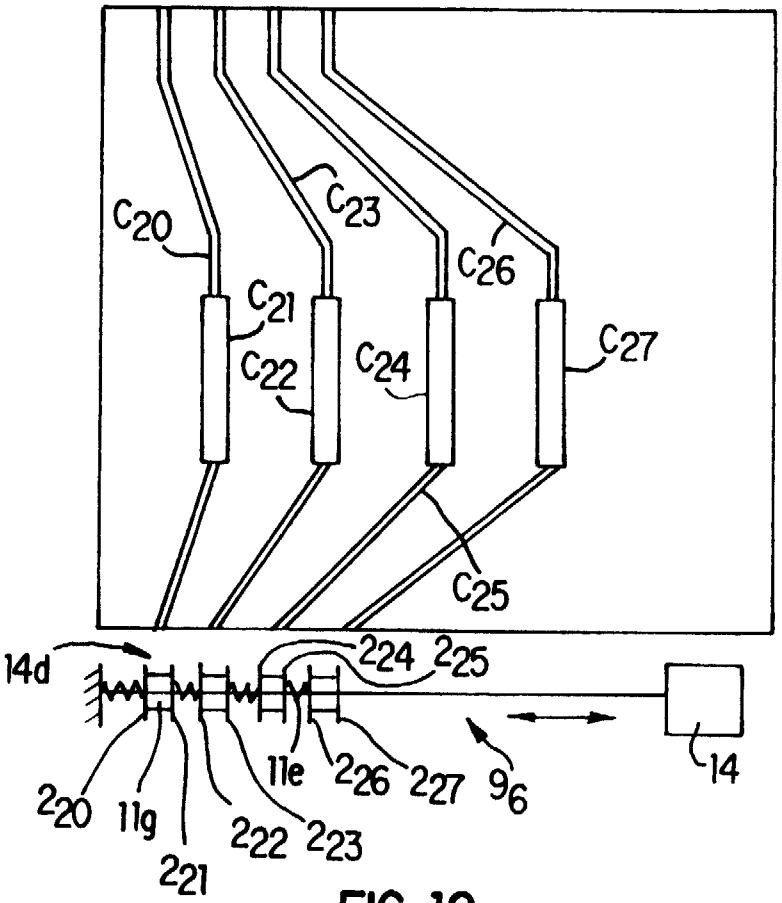

The pattern shown in FIG. 18*e* is produced by a chain of elements and blocks firmly connected unilaterally to the adjustment guide bar $9_6$ and connected to a unilaterally acting control device 14. In each case, two adjacent yarn guide blocks $2_{20}$ and $2_{21}$, $2_{22}$ and $2_{23}$, and $2_{24}$ and $2_{25}$, respectively, are integrated into the chain of elements and blocks; each of these pairs is connected with an additional distance altering element 11*g*, for example an expansion device, and an additional control device 14*d*, by means of which the two yarn guide blocks, which are arranged side by side, are additionally spread apart and then brought together again.

The pattern shown in FIG. 18*f* is produced by means of a chain of elements and blocks arranged unilaterally on the adjustment guide bar $9_7$ and connected with a unilaterally acting control device 14, a catch mechanism 28 being assigned to each of the first two yarn guide blocks 2. The catch mechanism is moved into the path of the yarn guide blocks and thereby limits their possible path.

We claim:

1. A textile machine comprising a linear array of a plurality of means each for forming a respective one of a plurality of warp yarns into stitches and a guide bar for guiding the warp yarns to the stitch forming means, the guide bar including at least two yarn guide blocks and a common guiding means for the yarn guide blocks, the guiding means having a linear, elongated lengthwise dimension substantially parallel to the linear array of stitch forming means, each of the yarn guide blocks having means for guiding at least one warp yarn, at least one distance altering element for variably altering the distance between said yarn guide blocks in the lengthwise dimension of the guiding means and means for controlling the distance altering element thereby to vary said distance.

2. A textile machine according to claim 1, in which the yarn guide blocks and distance altering element are connected in a chain configuration and said controlling means is positioned to push or pull at least one end of the chain.

3. A textile machine according to claim 1, in which the distance altering element comprises an elastic element and the means for controlling the distance altering element comprises means for stretching or compressing the elastic element.

4. A textile machine according to claim 1, in which the distance altering element is a spring.

5. A textile machine according to claim 1, further comprising controllable limit means for limiting the distance between said yarn guide blocks.

6. A textile machine according to claim 5, in which said limit means comprises means for blocking movement of at least one of said yarn guide blocks in one direction.

7. A textile machine according to claim 5, in which said limit means comprises means for completely blocking movement of one of said yarn guide blocks.

8. A textile machine according to claim 1, further comprising at least a third yarn guide block and at least a second distance altering element, the yarn guide blocks and distance altering elements being connected in alternating sequence in a chain configuration, the distance altering elements each comprising a spring, the springs not all having the same spring constant.

9. A textile machine according to claim 1, further comprising at least a third yarn guide block and at least a second distance altering element, the yarn guide blocks and distance altering elements being connected in alternating sequence in a chain configuration, the distance altering elements each being elastic and not all having the same modulus of elasticity.

10. A textile machine according to claim 1, in which the means for forming the warp yarns into stitches comprises needles, at least some of the needles being located so as to receive warp yarns from the movable yarn guide block, the movable yarn guide block having a respective yarn guide for each yarn to be guided thereby, and the machine comprising means for centering the yarn guides of the movable yarn guide block relative to said needles which are to receive warp yarns from the movable yarn guide block.

11. A textile machine according to claim 1, comprising means for programming the controlling means.

* * * * *